US011194274B2

(12) United States Patent
Kim et al.

(10) Patent No.: US 11,194,274 B2
(45) Date of Patent: Dec. 7, 2021

(54) ENDLESS FUSER BELT SUPPORTED BY ROTATION MEMBER AND WASHER

(71) Applicant: HEWLETT-PACKARD DEVELOPMENT COMPANY, L.P., Spring, TX (US)

(72) Inventors: Dong Kyun Kim, Pangyo (KR); Bong Hee Lee, Pangyo (KR); Seong Yul Kim, Suwon (KR); Se Min An, Suwon (KR); Jin Seok Lee, Pangyo (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 17/051,063

(22) PCT Filed: Nov. 21, 2018

(86) PCT No.: PCT/KR2018/014313

§ 371 (c)(1),
(2) Date: Oct. 27, 2020

(87) PCT Pub. No.: WO2019/245114

PCT Pub. Date: Dec. 26, 2019

(65) Prior Publication Data

US 2021/0124294 A1 Apr. 29, 2021

(30) Foreign Application Priority Data

Jun. 18, 2018 (KR) ..... 10-2018-0069817

(51) Int. Cl.
*G03G 15/20* (2006.01)
*G03G 21/16* (2006.01)

(52) U.S. Cl.
CPC ..... *G03G 15/2053* (2013.01); *G03G 21/1647* (2013.01)

(58) Field of Classification Search
CPC ..... G03G 15/2017; G03G 15/2053; G03G 2215/2003; G03G 2215/2016; G03G 2215/2035
See application file for complete search history.

(56) References Cited

U.S. PATENT DOCUMENTS 7,660,553 B2 2/2010 Kikuchi
9,091,980 B2 7/2015 Egi
(Continued)

FOREIGN PATENT DOCUMENTS

JP 2005338220 A 12/2005
JP 2015125325 A 7/2015

*Primary Examiner* — Thomas S Giampaolo, II
(74) *Attorney, Agent, or Firm* — Staas & Halsey, LLP

(57) ABSTRACT

A fuser including an endless belt, a pressurizing roller, a heater, a shaft supporting member, rotation member, and a washer. The pressurizing roller is to form a heating nip with the endless belt and is to rotate to drive the endless belt. The heater is to supply heat to the heating nip. The supporting member includes a shaft and a flange The rotation member is inserted into an inner diameter portion of the endless belt to support the endless belt, the rotation member is to be slidably rotatable with respect to the shaft. A washer interposed between the rotation member and the flange in an axial direction to regulate a movement of the endless belt in the axial direction, the washer is to slide-contact with at least one of the flange and the rotation member.

14 Claims, 8 Drawing Sheets

(56) References Cited

U.S. PATENT DOCUMENTS

| | | | | |
|---|---|---|---|---|
| 2012/0155935 | A1 | 6/2012 | Yoshikawa et al. | |
| 2012/0177388 | A1 | 7/2012 | Imada et al. | |
| 2013/0177340 | A1 | 7/2013 | Kawata et al. | |
| 2013/0195524 | A1 | 8/2013 | Ishii et al. | |
| 2013/0209146 | A1* | 8/2013 | Yamaji ..... | G03G 15/206 399/329 |
| 2016/0327893 | A1 | 11/2016 | Kim et al. | |

* cited by examiner

[Figure 1]
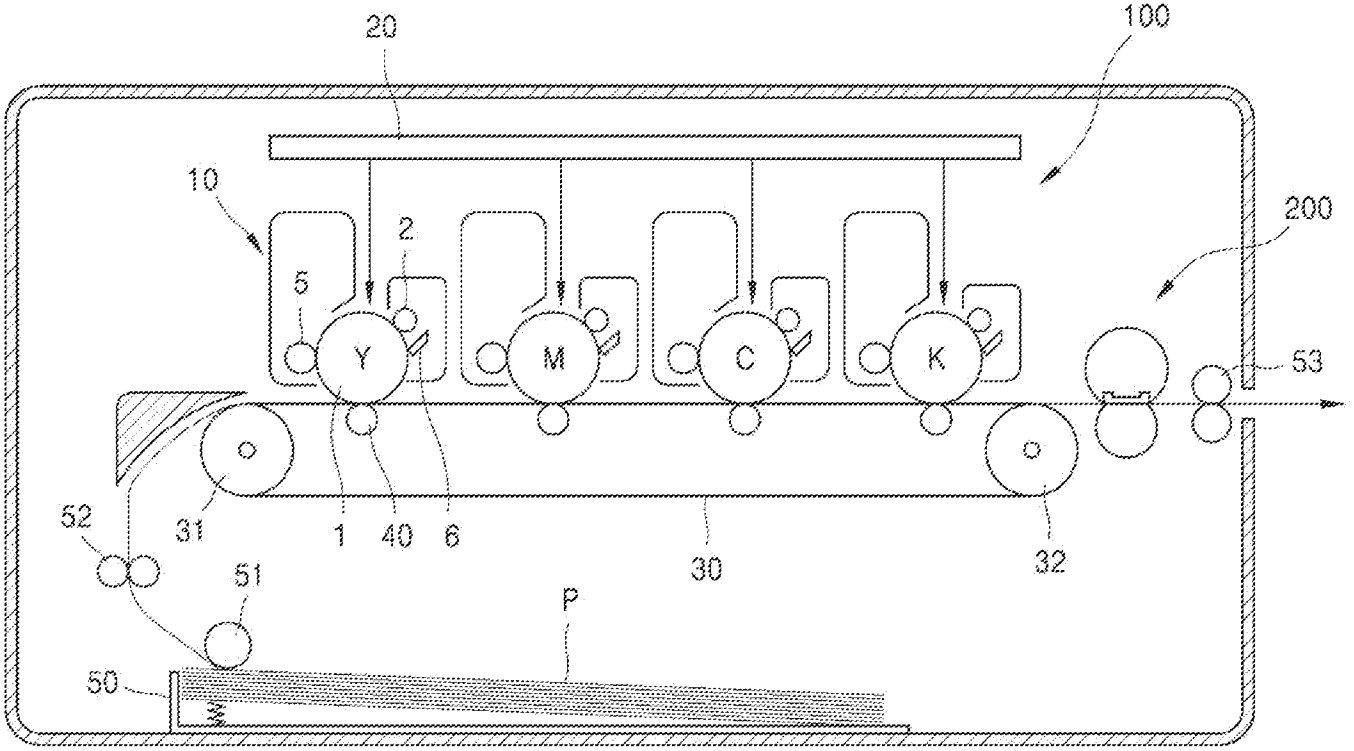

【Figure 2】
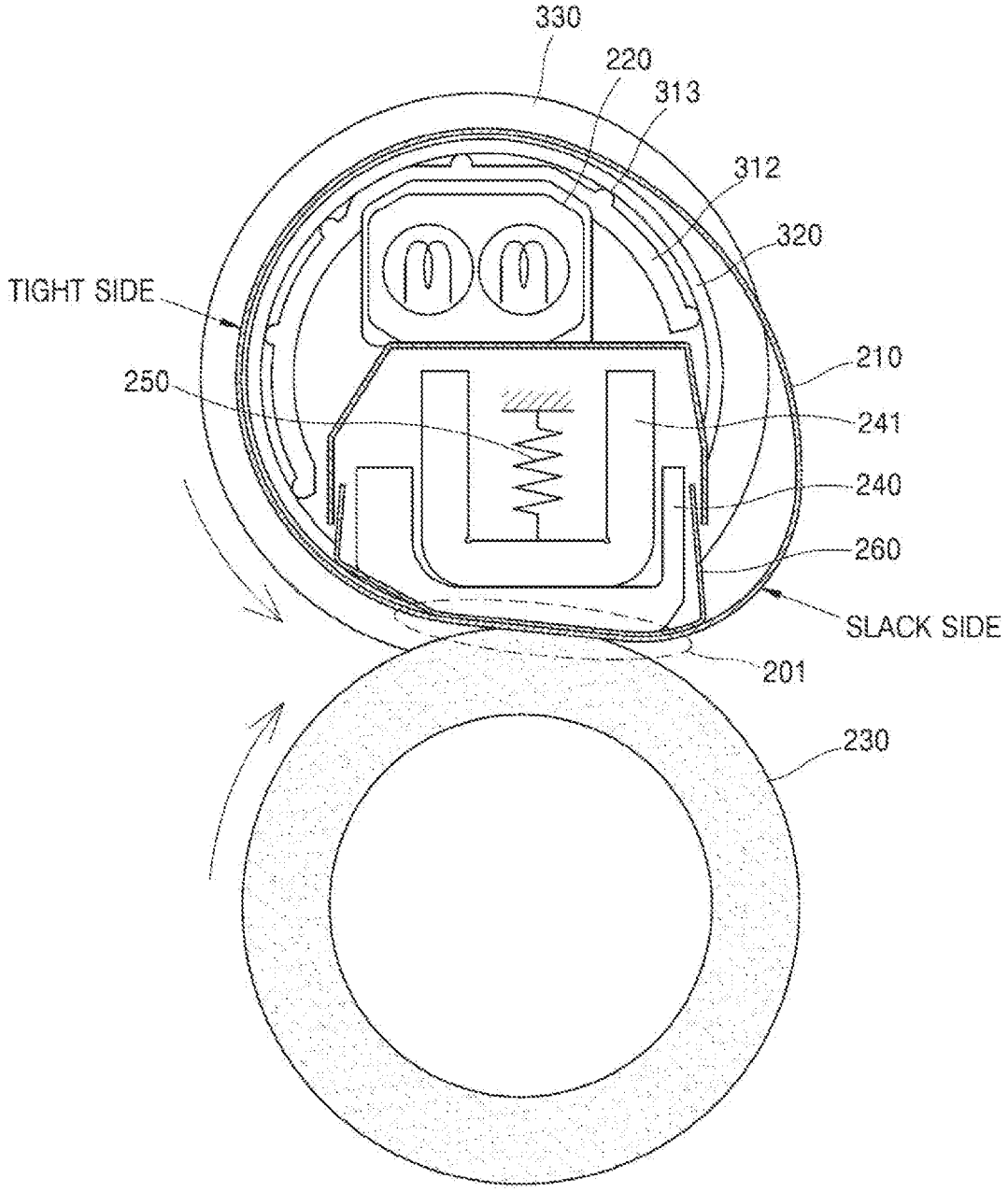

[Figure 3]
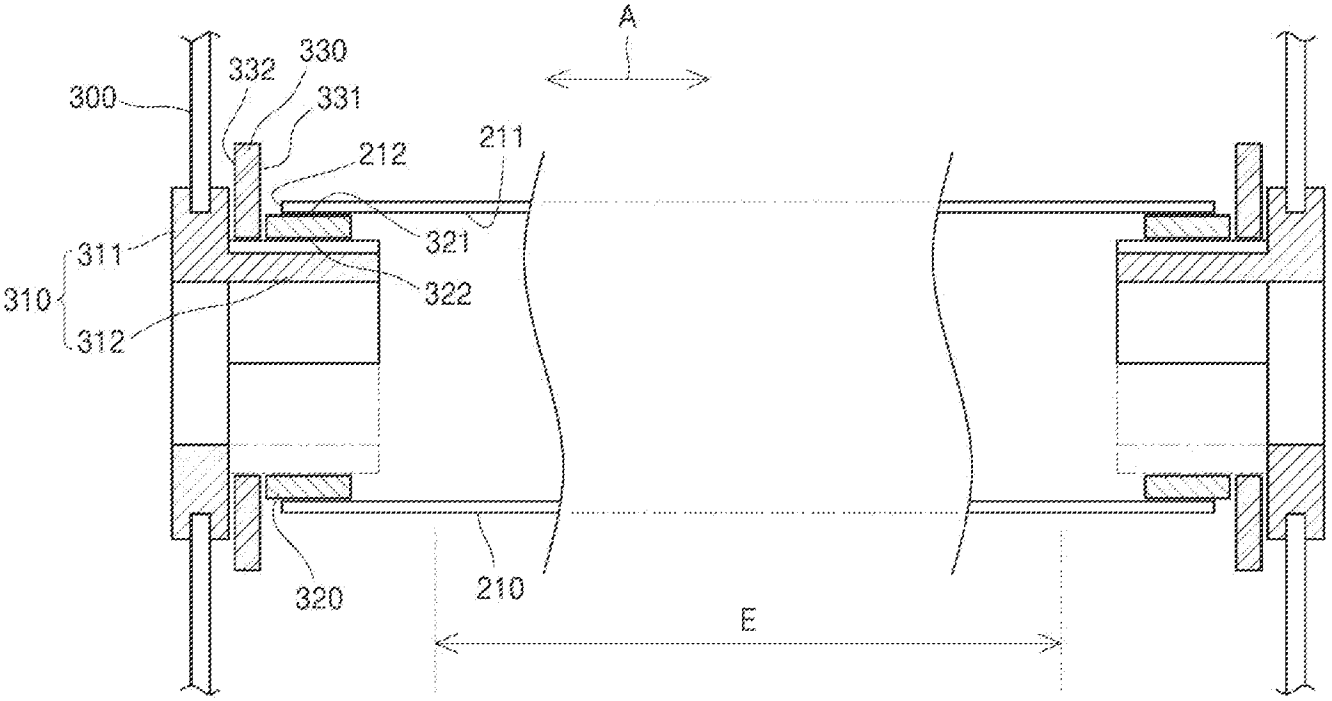

【Figure 4】
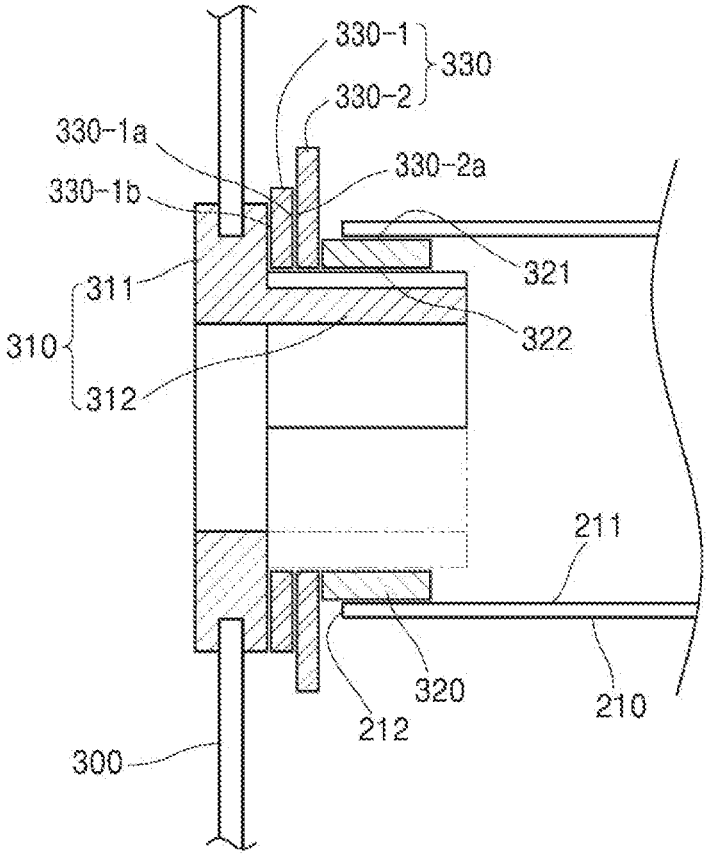

【Figure 5】
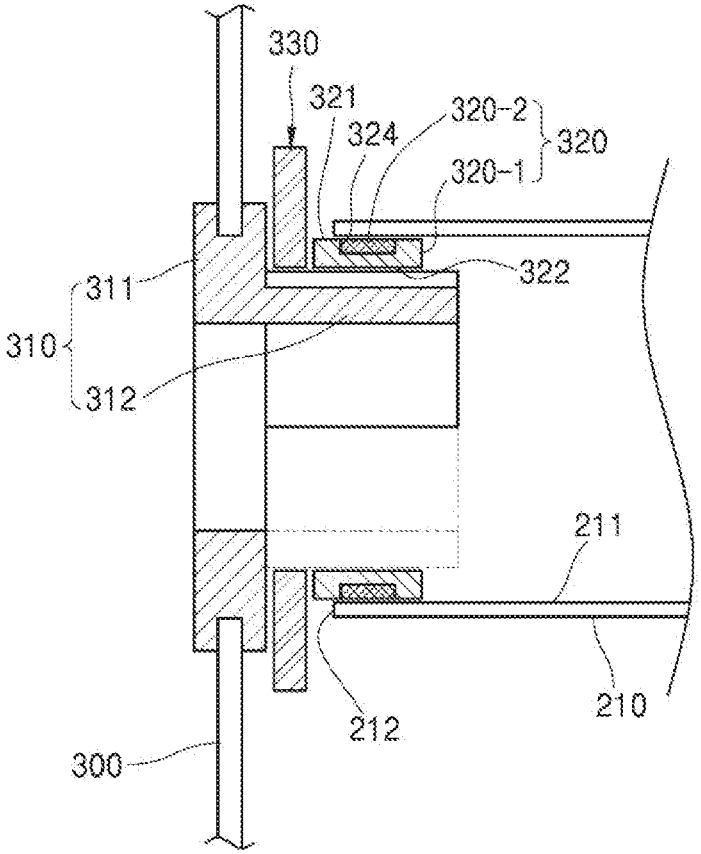

【Figure 6】
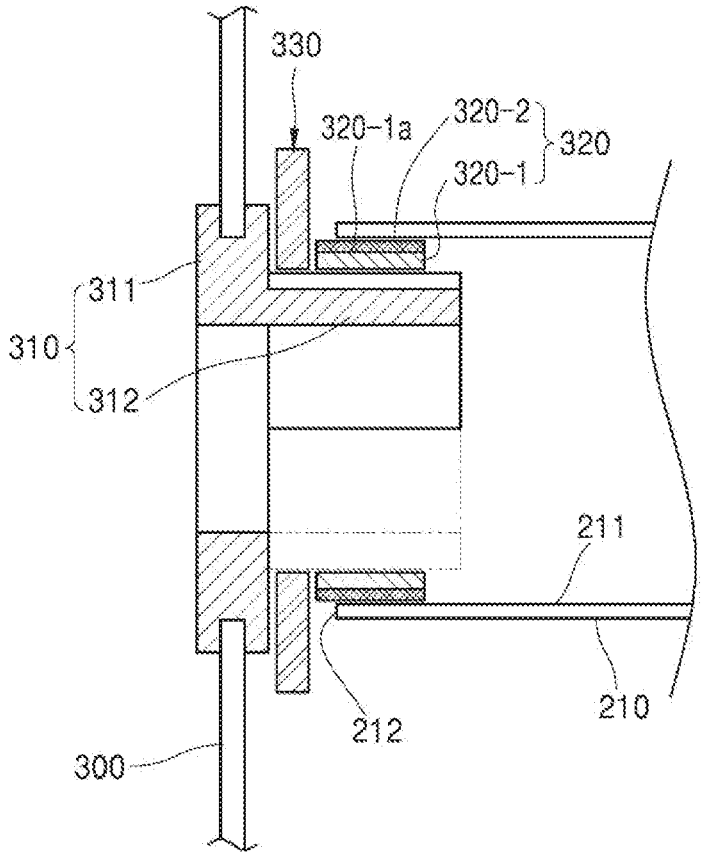
【Figure 7】
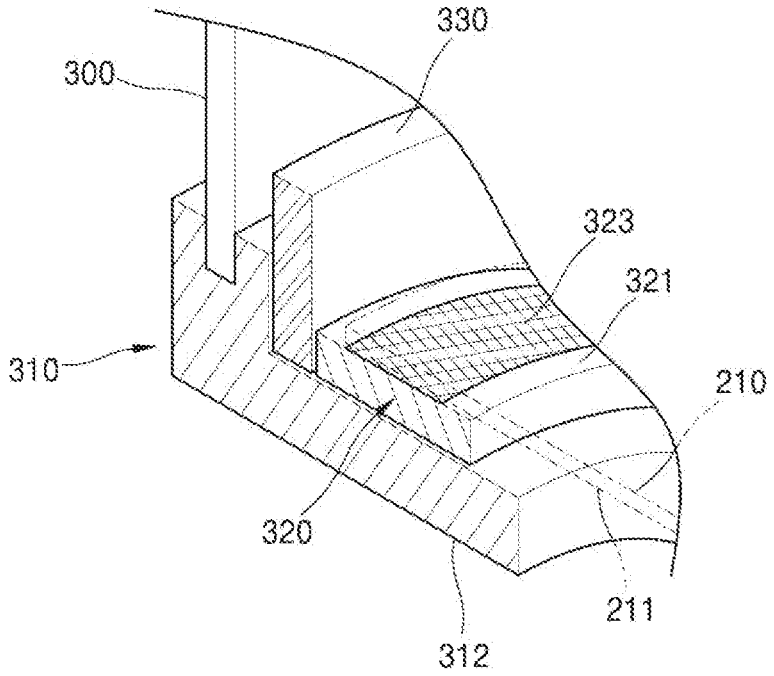

【Figure 8】
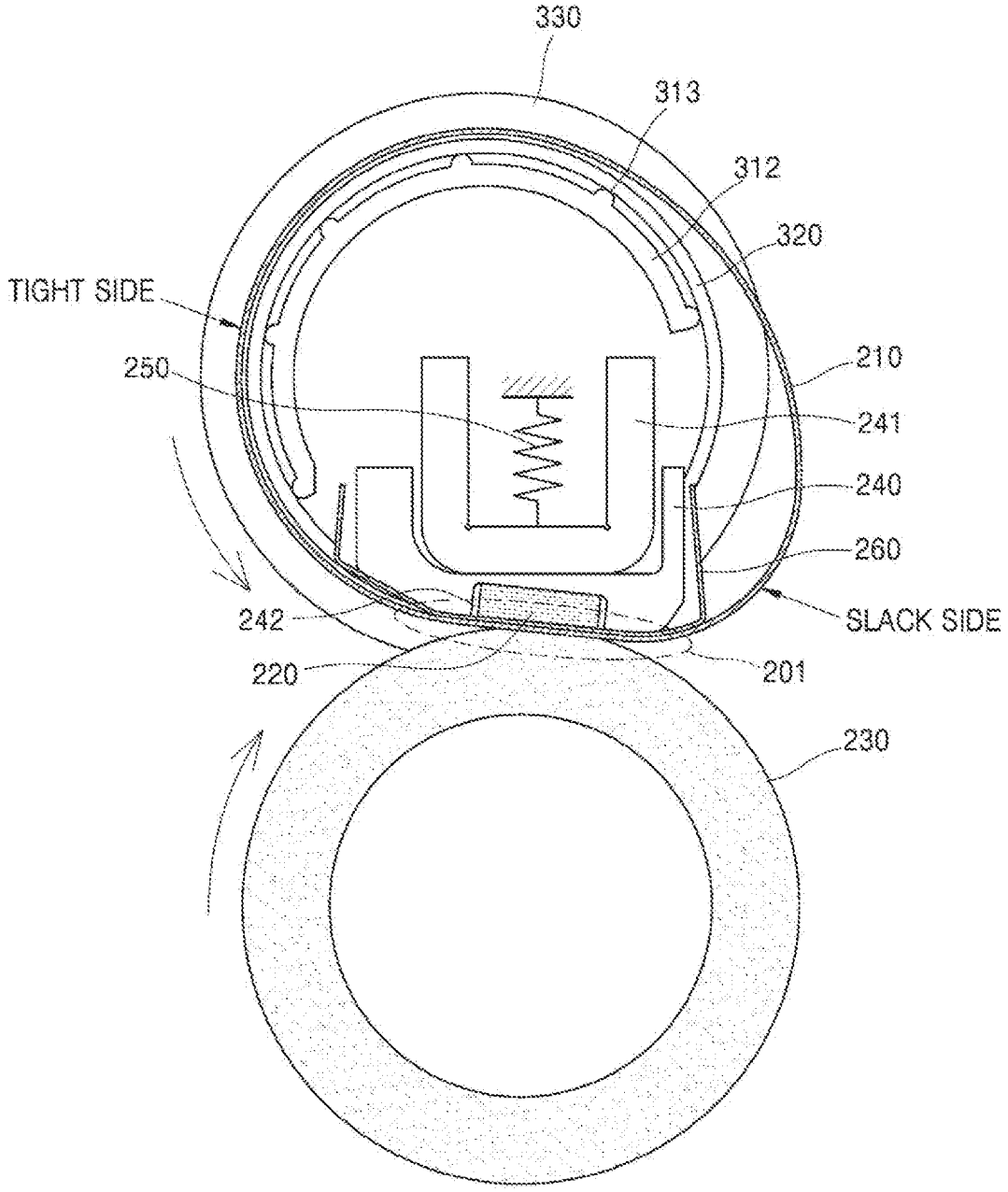

【Figure 9】
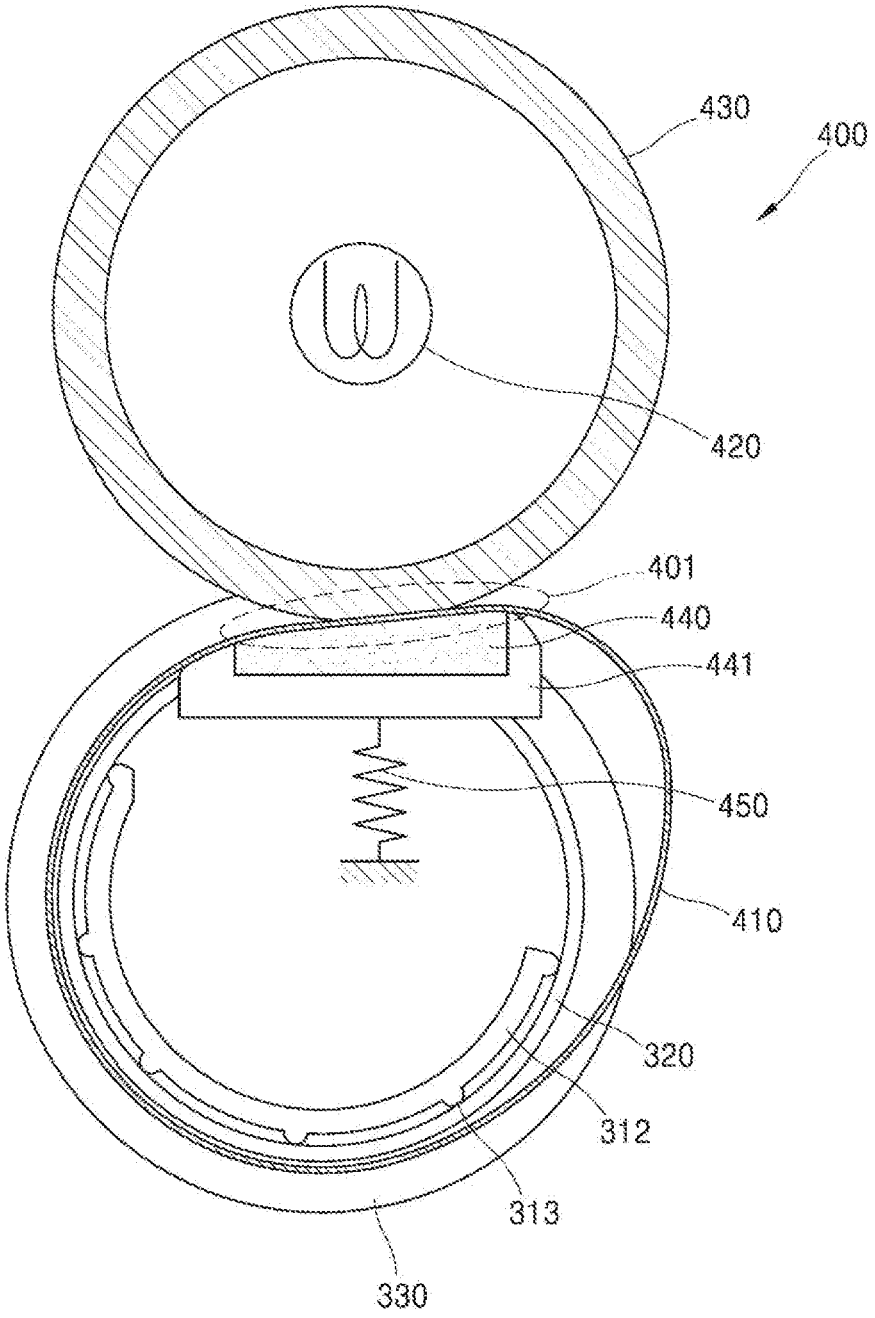

ENDLESS FUSER BELT SUPPORTED BY ROTATION MEMBER AND WASHER

CROSS REFERENCE TO RELATED APPLICATIONS

This application is a U.S. National Stage Application which claims the benefit under 35 U.S.C. § 371 of International Patent Application No. PCT/KR2018/014313 filed on Nov. 21, 2018, which claims priority from Korean Application No. 10-2018-0069817 filed on Jun. 18, 2018, the contents of which are incorporated herein by reference.

BACKGROUND ART

A print medium on which an image is printed is subjected to heat and pressure while the print medium passes through a fuser, thereby fixing the image onto the print medium. When the print medium passes through the fuser, a curl of the print medium is straightened, the print medium can be planarized, and a surface roughness can be reduced.

A configuration of the fuser may vary. According to an example, the fuser may include a heating member heated by a heater, and a pressing member engaged with the heating member to form a heating nip. The print medium passes through the heating nip, and is subjected to heat and pressure during this process. The shape of the heating member, and the type of the heater may vary.

A temperature of the heating member is to rise quickly to a fusing temperature. The smaller the heat capacity of the member, the faster the heating member can be heated up to the fusing temperature. An endless belt can be employed as the heating member with the smaller heat capacity. A pressurizing roller and the endless belt are pressed against each other to form the heating nip. The endless belt undergoes driven rotation as the pressurizing roller rotates.

DESCRIPTION OF DRAWINGS

FIG. 1 is a schematic configuration diagram of an example of a printer;

FIG. 2 is a schematic cross-sectional view of an example of a fuser;

FIG. 3 is a schematic cross-sectional view of an example of a configuration rotatably supporting an endless belt;

FIG. 4 is a schematic cross-sectional view of an example of a configuration rotatably supporting an endless belt;

FIG. 5 is a schematic cross-sectional view of an example of a configuration rotatably supporting an endless belt;

FIG. 6 is a schematic cross-sectional view of an example of a configuration rotatably supporting an endless belt;

FIG. 7 is a partial cross-sectional perspective view of an example of a configuration rotatably supporting an endless belt;

FIG. 8 is a schematic cross-sectional view of an example of a fuser; and

FIG. 9 is a schematic configuration diagram of an example of a fuser.

MODE FOR INVENTION

FIG. 1 is a schematic configuration diagram of an example of a printer applicable to a fuser of the present disclosure. Referring to FIG. 1, the printer may include a print unit 100 for forming a visible toner image on a print medium P, for example, a paper, and a fuser 200 fixing the toner image on the print medium P. The print unit 100 of the present example forms a colored toner image on the print medium P by using an electrophotographic method.

The print unit 100 may include a plurality of photosensitive drums 1, and a plurality of developing devices 10 and a paper transporting belt 30. The photosensitive drum 1 is an example of a photoconductor forming an electrostatic latent image on the surface thereof, which may include a conductive metal pipe, and a photosensitive layer formed on the periphery thereof. The plurality of developing devices 10 respectively corresponds to the plurality of photosensitive drums 1, and forms a toner imager on the surfaces of the plurality of photosensitive drums 1, by supplying the toner to the electrostatic latent image formed on the plurality of photosensitive drums 1 and developing the electrostatic latent image. Each of the plurality of developing devices 10 may be replaceable separately with the plurality of photosensitive drums 1. In addition, each of the plurality of developing devices 10 may be in a form of cartridge including the photosensitive drum 1.

For color printing, the plurality of developing devices 10 may include the plurality of developing devices 10Y, 10M, 10C and 10K which respectively accommodate the toners of yellow Y, magenta M, cyan C, and black K colors. Besides the colors described above, the developing device 10 accommodating the toners of various colors such as light magenta, and white may be further employed. Hereinafter, a printer including a plurality of developing devices 10Y, 10M, 10C, and 10K will be described. Unless otherwise specified, reference symbols Y, M, C, and K refer to a configuration component for printing an image by using toners of yellow, magenta, cyan, and black.

The developing device 10 supplies the toner accommodated inside therein to the electrostatic latent image formed on the photosensitive drum 1, to develop the electrostatic latent image into a visible toner image. The developing device 10 may include a developing roller 5. The developing roller 5 supplies the toner, which is inside the developing device 10, to the photosensitive drum 1. A developing bias voltage may be applied to the developing roller 5. A regulating member, which is not illustrated, regulates the amount of toners supplied to a developing area, where the photosensitive drum 1 and the developing roller 5 face each other, by the developing roller 5.

A charging roller 2 is an example of a charger, which charges the photosensitive drum 1 to have a uniform surface electric potential. Instead of the charging roller 2, a charging brush, a corona charger, etc. may be employed.

A cleaning blade 6 is an example of a cleaning member, which removes the toners, and foreign material remained on the surface of the photosensitive drum 1, after the transferring process. Instead of the cleaning blade 6, other types of the cleaning devices, such as a rotating brush, may be employed.

An exposure device 20 irradiates the modulated light on the photosensitive drum 1Y, 1M, 1C, and 1K, corresponding to image information, and forms the electrostatic latent image, corresponding to image of colors of yellow, magenta, cyan, and black respectively on the photosensitive drum 1Y, 1M, 1C, and 1K. A laser scanning unit (LSU) using a laser diode as a light source, a light emitting diode (LED) exposure device using an LED as the light source, or the like may be employed as the exposure device 20.

The paper transporting belt 30 supports and transports the print medium P. The paper transporting belt 30 may be supported by, for example, a supporting roller 31 and 32, and be circulated. The print medium P may be picked up one by one from a loading table 50 by a pickup roller 51, and may be transported by a transporting roller 52, and may be attached to the paper transporting belt 30 by, for example, an electrostatic force. A plurality of transfer rollers 40 may be arranged to face the plurality of photosensitive drums 1Y, 1M, 1C, and 1K with the paper transporting belt 30 interposed therebetween. The plurality of transfer rollers 40 may be an example of a transfer unit, which transfers the toner image from the plurality of photosensitive drums 1Y, 1M, 1C, and 1K to the print medium P, supported by the paper transporting belt 30. A transfer bias voltage for transferring the toner image to the print medium P, is applied to the plurality of transfer rollers 40. Instead of the transfer roller 40, a corona transfer unit, or a transfer unit of pin scorotron method may be employed.

The fuser 200 may apply heat and/or pressure to the image transferred to the print medium P, and the image is fixed on the print medium P. The print medium P passed through the fuser 200 is discharged by a discharge roller 53.

With the above configuration, the exposure device 20, along with the image information of each color, scans a modulated plurality of lights on the photosensitive drums 1Y, 1M, 1C, and 1K respectively, to form the electrostatic latent image. The plurality of developing devices 10Y, 10M, 10C, and 10K, respectively supplies toners of Y, M, C, and K colors to the electrostatic latent image formed on the photosensitive drums 1Y, 1M, 1C, and 1K, and a visible toner image of Y, M, C, and K colors is formed on the surface of the photosensitive drums 1Y, 1M, 1C, and 1K. The print medium P loaded on the loading table 50, is supplied to the paper transporting belt 30 by the pickup roller 51, and the transporting roller 52, and is maintained on the paper transporting belt 30 by, for example, the electrostatic force. The toner images of colors of Y, M, C, and K, are sequentially transferred to the print medium P transported by the paper transporting belt 30 by the transfer bias voltage applied to the plurality of transfer rollers 40. When the print medium P passes through the fuser 200, the toner image is fixed on the print medium P by heat and pressure. The print medium P, which the fixing is completed, is discharged by the discharge roller 53.

Although the printer shown in FIG. 1, employs a method of directly transferring the toner image formed on the plurality of photosensitive drums 1Y, 1M, 1C, and 1K, to the print medium P supported by the paper transporting belt 30, other transfer method is also possible. For example, a transfer method may be employed, in which the toner image developed on the plurality of photosensitive drums 1Y, 1M, 1C, and 1K is intermediately transferred to an intermediate transfer belt (not shown), and thereafter transferred again to the print medium P.

In a case of printing a monochrome image, for example, a black colored image, the printer may include the developing device 10K from among the plurality of developing devices 10Y, 10M, 10C, and 10K. The paper transporting belt may not be included. The print medium P may be transported between the photosensitive drum 1K and the transfer roller 40, the toner image developed on the photosensitive drum 1K may be transferred to the print medium P, by the transfer bias voltage applied to the transfer roller 40.

The fuser 200 fixes the toner image on the print medium P, by applying heat and pressure. To increase the printing speed, and reduce the energy consumption, the fuser 200 may employ a heating portion with small heat capacity. For example, an endless belt in a form of a thin film may be employed as the heating portion. Thus, the temperature of the fuser 200 may be rapidly raised to a temperature, which is possible for fixing, and printing may be performed quickly after turning on the power of the printer.

Hereinafter, an example of the fuser 200 will be described.

FIG. 2 is a schematic cross-sectional view of an example of the fuser 200. Referring to FIG. 2, the fuser 200 may include, a rotating endless belt 210, a pressurizing roller 230 positioned outside the endless belt 210 to form a heating nip 201 with the endless belt 210, and a heater 220 for supplying heat to the heating nip 201. The pressurizing roller 230 applies pressure to the endless belt 210, and rotates, to drive the endless belt 210.

The heater 220 of the present example, heats up the endless belt 210, and supplies heat to the heating nip 201 by the heated endless belt 210. The print medium P passes through the heating nip 201. The endless belt 210 is positioned facing the image surface of the print medium P. The heater 220 may be located inside the endless belt 210. The heater 220 may heat up the endless belt 210 in a non-contact state. According to an example, the heater 220 may be a halogen lamp.

The endless belt 210 may include, for example, a substrate in a film form. The substrate may be, for example, a metal film such as a stainless steel film, and a nickel film. In addition, the substrate may be a polymer film with heat resistance and abrasion resistance, which is capable of withstanding the heating temperature of the fuser 200, for example, at a temperature about 120° C. to 200° C. For example, the substrate may include a polyimide film, a polyamide film, a polyimideamide film, or the like. A thickness of the substrate may be set such that the endless belt 210 may have flexibility and elasticity in which the endless belt 210 is flexibly transformed in the heating nip 201, and may be recovered to its original state after the endless belt 210 is released from the heating nip 201. For example, the thickness of the substrate may be about tens to hundreds of micrometers.

An outermost layer of the endless belt 210 may be a release layer. The release layer may prevent the print medium P, which is freed from the heating nip 201, from being attached to the outer surface of the endless belt 210 without being separated from the same. The release layer may be a resin layer with excellent separability. The release layer may be, for example, one of a perfluoroalkoxy (PFA), a polytetrafluoroethylenes (PTFE), and a fluorinated ethylene prophylene (FEP), a blend of two or more thereof, or a copolymer thereof.

An elastic layer may be interposed between the substrate and the release layer. The elastic layer may include a material having the heat resistance, which is capable of withstanding the heating temperature, to allow the heating nip 201 to be easily formed. For example, the elastic layer may include a rubber material, such as a fluorine rubber, a silicon rubber, a natural rubber, an isoprene rubber, a butadiene rubber, a nitrile rubber, a chloroprene rubber, a butyl rubber, an acrylic rubber, a hydrin rubber and a uren rubber; and include one, or the blend, or a complex of the various types of thermoplastic elastomers, such as a styrene type, a polyolefin type, a polyvinyl chloride type, a polyurenthane type, a polyester type, a polyamide type, a polybutadiene type, a trans-polyisoprene type, and a chlorinated polyethlene type.

The pressurizing roller 230 may be in a form of the elastic layer formed on an outer circumference of the metal type core. A backup member 240 may be positioned inside the endless belt 210 so as to face the pressurizing roller 230. An elastic member 250 provides, to the backup member 240, an elastic force that is toward the pressurizing roller 230. For example, the elastic member 250 may push the backup member 240 towards the pressurizing roller 230 by having an intermediate member 241 interposed therebetween. By doing so, the backup member 240 is pressurized toward the pressurizing roller 230 by having the endless belt 210 interposed therebetween, and the heating nip 201 in which the print medium P passes may be formed between the endless belt 210 and the pressurizing roller 230. When the pressurizing roller 230 that is pressurized while having the endless belt 210 interposed between the backup member 240 and the pressurizing roller 230 is rotated, the endless belt 210 may be driven.

A thermal conductive plate 260 may be interposed between the endless belt 210 and the backup member 240. The thermal conductive plate 260 may be a metallic thin plate. A temperature of the heating nip 201 may be uniformed by interposing the thermal conductive plate 260 between the endless belt 210 and the backup member 240. In addition, the heat transfer range to the print medium P may be enlarged by making the width of the thermal conductive plate 260 greater than the width of the heating nip 201.

Although not illustrated in drawings, the fuser 200 may include a temperature sensor for sensing the temperature of the endless belt 210. Based on the temperature of the endless belt 210 sensed by the temperature sensor, a controller, which is not shown, may control the heater 220 to maintain the endless belt 210 at a proper heating temperature. The fuser 200 may include an overheating preventing member. The overheating preventing member cuts off the power transmitted to the heater 220, when the temperature of the endless belt 210 exceeds a predetermined temperature. The overheating preventing member may include, for example, a thermostat. The temperature sensor, and the overheating preventing member may be installed in contact with or close to the endless belt 210.

As described above, the endless belt 210 is driven and rotated as the pressurizing roller 230 is rotated. Hereinafter, an example of a configuration for rotatably supporting the endless belt 210.

FIG. 3 is a schematic cross-sectional view of an example of a configuration rotatably supporting the endless belt 210. Referring to FIGS. 2 and 3, a pair of shaft supporting members 310 which is spaced apart in a longitudinal direction A of the endless belt 210 is shown. For example, the fuser 200 may include a pair of side frames 300, and the pair of shaft supporting members 310 may be installed in the pair of side frames 300. The pair of shaft supporting members 310 may be integrated with the pair of side frames 300, and may be assembled at the pair of side frames 300.

The shaft supporting member 310 includes a shaft 312 and a flange 311. The shaft 312 extends from the flange 311 to the longitudinal direction A. The diameter of the flange 311 is greater than the diameter of the shaft 312. As shown in FIG. 2, the shaft 312 in the present example has a partially-cylindrical shape, and in this case, a diameter of the shaft 312 indicates a diameter of the partially-cylindrical shape. In addition, to reduce a friction, a plurality of protruding portions 313 may be provided on the outer circumference of the shaft 312, to reduce the contact area with a member installed to be rotatable with respect to the shaft 312. The plurality of protruding portions 313 may be in the form of ribs extending in the longitudinal direction A.

A pair of rotation members 320 is inserted into an inner diameter portion 211 of the endless belt 210 from both ends of the endless belt 210 so as to support the endless belt 210. The pair of rotation members 320 is respectively supported to be rotatable with respect to the pair of shaft supporting members 310. The rotation member 320 is supported to be slidably rotatable with respect to the shaft 312. The rotation member 320 may be a hollow cylindrical member. The rotation member 320 may be rotated by following the rotation of the endless belt 210.

The shaft supporting member 310 and the rotation member 320 are positioned outside an effective image region E in the longitudinal direction A of the endless belt 210. The effective image region E may refer to a region where the heating nip 201 is formed.

The rotation member 320 includes an outer circumference portion 321 inserted into the inner diameter portion 211 of the endless belt 210, and an inner circumstance portion 322 in which the shaft 312 is inserted into therein. The outer circumference portion 321 contacts the inner diameter portion 211 of the endless belt 210 to support the inner diameter portion 211. The rotation member 320 of the present example is loosely inserted into the inner diameter portion 211 of the endless belt 210 from the both ends of the longitudinal direction A of the endless belt 210. When the pressurizing roller 230 rotates, the pressurizing roller 230 in the heating nip 201 pulls the endless belt 210. The endless belt 210 is rotated by tension generated at this time. With respect to the heating nip 201, a side of the endless belt 210 becomes a tight side, and the other side becomes a slack side. The inner circumference portion 322 of the tight side of the endless belt 210 tightly contacts to the outer circumference portion 321 of the rotation member 320, and the rotation power is applied to the rotation member 320 by the endless belt 210. The inner circumference portion 322 of the rotation member 320 slide-contacts with the shaft 312. Therefore, when the endless belt 210 is rotated, the rotation member 320 may be slide-rotated together with the endless belt 210, with respect to the shaft 312.

When the endless belt 210 is rotated, a thrust of an axial direction, that is, the longitudinal direction A may be generated. The endless belt 210 and the rotation member 320 may be pushed towards the flange 311 by the thrust. When the rotation member 320 contacts with the flange 311, the friction may be occurred. The rotation member 320 is to be stably rotated by following the rotation of the endless belt 210. The rotation member 320 may be rotated at the same rotation linear velocity as the endless belt 210. When a contact friction between the rotation member 320 and the flange 311 occurs, the rotation member 320 is not smoothly rotated with respect to the shaft 312 such that a difference between the rotation linear velocity of the rotation member 320 and the rotation linear velocity of the endless belt 210 may be increased. When the difference between the rotation linear velocity of the rotation member 320 and the rotation linear velocity of the endless belt 210 increases, a slip may occur between the outer circumference portion 321 of the rotation member 320 and the inner diameter portion 211 of the endless belt 210 such that the outer circumference portion 321 and the inner diameter portion 211 may be worn. In addition, a friction stress is applied to the endless belt 210 such that the endless belt 210 may be damaged.

According to the fuser 200 of the present example, a friction reducing member is interposed between the rotation member 320 and the flange 311. Therefore, even if the rotation member 320 is pushed towards the longitudinal direction A by the thrust, a direct contact between the rotation member 320 and the flange 311 may be prevented. The friction reducing member slide-contacts with at least one of the rotation member 320 and the flange 311, in the axial direction, that is, the longitudinal direction A. The friction reducing member may be include a material having a small frictional resistance, or a surface of the longitudinal direction A of the friction reducing member may be coated with the material having a small frictional resistance, to reduce the frictional resistance of at least one of the rotation member 320 and the flange 311, with the friction reducing member. Therefore, the rotation member 320 may be stably rotated by following the rotation of the endless belt 210, and a decrease in a service life of the fuser 200 due to the damage of the endless belt may be prevented. The material having small frictional resistance may be, for example, a polytetrafluoroethylenes (PTFE) resin.

The friction reducing member may regulate a movement of the endless belt 210 in the axial direction, that is, the longitudinal direction A. To this end, a diameter of the friction reducing member may be greater than a diameter of the rotation member 320. When the endless belt 210 is pushed towards the longitudinal direction A by the thrust, an end 212 of the endless belt 210 contacts with the friction reducing member, and the endless belt 210 is no longer pushed towards the longitudinal direction A.

According to an example, the friction reducing member may be realized by a washer 330, which is interposed between the rotation member 320 and the flange 311. To regulate the movement of the endless belt 210 in the axial direction, that is, the longitudinal direction A, a diameter of the washer 330 is greater than the diameter of the rotation member 320. The washer 330 may be fixed to the shaft supporting member 310, and be sliding contacted with the rotation member 320. A fixing method is not particularly limited. For example, the washer 330 may be inserted into the shaft 312 by an interference fit method, or be adhered to the shaft 312, or be adhered to the flange 311. The washer 330 may include the material having a small frictional resistance, or at least a side 331 of the washer 330 facing the rotation member 320, may be coated with the material having the small frictional resistance.

The washer 330 is supported to be rotatable with respect to the shaft 312, and may be slide-contacted with the flange 311. In this case, the washer 330 may be include the material having the small fractional resistance, or at least a side 332 of the washer 330 facing the flange 311 may be coated with the material having the small frictional resistance.

The friction reducing member may include an outside member and an inside member. The outside member may be faced the flange 311, and the inside member may be interposed between the outside member and the rotation member 320. The outside member and the flange 311, and/or the outside member and the inside member, and/or the inside member and the rotation member 320, may be slide-contacted.

FIG. 4 is a schematic cross-sectional view of an example of a configuration rotatably supporting the endless belt 210. Referring to FIG. 4, the washer (friction reducing member) 330 may include an outside washer 330-1 (outside member) which faces the flange 311, and an inside washer 330-2 (inside member), which is interposed between the outside washer 330-1 and the rotation member 320.

As an example, the outside washer 330-1 may be fixed to the shaft supporting member 310, and the inside washer 330-2 may be installed to be rotatable with respect to the shaft 312. A fixing method of the outside washer 330-1 is not particularly limited. For example, the outside washer 330-1 may be inserted into the shaft 312 by the interference fit method, or be adhered to the shaft 312, or be adhered to the flange 311. At least one of the outside washer 330-1 and the inside washer 330-2 may include the material having the small frictional resistance, or at least one of the side 330-1*a* of the outside washer 330-1 and the side 330-2*a* of the inside washer 330-2 facing each other may be coated with the material having the small frictional resistance.

To regulate the movement of the endless belt 210 in the axial direction, that is, the longitudinal direction A, a diameter of at least one of the outside washer 330-1 and the inside washer 330-2, is greater than the diameter of the rotation member 320. In the present example, the diameter of the inside washer 330-2 is greater than the diameter of the rotation member 320, and the movement of the endless belt 210 in the axial direction is regulated by the inside washer 330-2. In this case, the inside washer 330-2 may include a material with high wear resistance, which is capable of withstanding the friction of both ends 212 of the endless belt 210, for example, a polyetheretherketon (PEEK) resin. The outside washer 330-1 may include the material having the small frictional resistance, or at least one of the side 330-1*a* of the outside washer 330-1 and the side 330-2*a* of the inside washer 330-2 facing each other, may be coated with the material having the small frictional resistance. In the case where the movement of the endless belt 210 in the axial direction may be regulated by the outside washer 330-1, the outside washer 330-1 may include the material with high wear resistance, which is capable of withstanding the friction of the both ends 212 of the endless belt 210. The inside washer 330-2 may include the material having small frictional resistance, or at least one of at least one of the side 330-1*a* of the outside washer 330-1 and the side 330-2*a* of the inside washer 330-2 facing each other, may be coated with the material having the small frictional resistance.

In an example, both the outside washer 330-1 and the inside washer 330-2 are installed to be rotatable with respect to the shaft 312. In this case, at least one of the outside washer 330-1 and the inside washer 330-2 may include the material having the small frictional resistance, or at least one of the side 330-1*a* of the outside washer 330-1 and the side 330-2*a* of the inside washer 330-2 facing each other, and a side 330-1*b* of the outside washer 330-1 facing the flange 311, may be coated with the material having the small frictional resistance.

In the case where the movement of the endless belt 210 in the axial direction may be regulated by the inside washer 330-2, the inside washer 330-2 may include the material with high wear resistance, which is capable of withstanding the friction of the both ends 212 of the endless belt 210. The outside washer 330-1 may include the material having the small frictional resistance, or at least one of the sides 330-1*a* of the outside washer 330-1 and the side 330-2*a* of the inside washer 330-2 facing each other, and the side 330-1*b* of the outside washer 330-1 facing the flange 311 may be coated with the material having the small frictional resistance. In the case where the movement of the endless belt 210 in the axial direction is regulated by the outside washer 330-1, the outside washer 330-1 may include the material with high wear resistance, which is capable of withstanding the friction of both ends 212 of the endless belt 210. The inside washer 330-2 may include the material having the small frictional resistance, or at least one of the sides 330-1*a* of the outside washer 330-1 and the side 330-2*a* of the inside washer 330-2 facing each other, may be coated with the material having the small frictional resistance.

Table 1 shows a result of measuring a ratio of the rotation linear velocity of the rotation member 320 to the rotation linear velocity of the endless belt 210 according to a process of an operation time. A comparative example 1, and a comparative example 2, show a fuser according to the related art to which the washer 330 is not applied. An example 1 is the configuration of the fuser 200 in which the outside washer 330-1 is fixed to the shaft supporting member 310, and the inside washer 330-2 is installed to be rotatable with respect to the shaft 312, and the movement of the endless belt 210 in the axial direction is regulated by the inside washer 330-2. As shown in Table 1, in case of the fusers of the comparative example 1 and the comparative example 2, the rotation linear velocity thereof is not uniform. To the contrary, the fuser 200 from the example 1 maintains the ratio of the rotation linear velocity of the rotation member 320 to the rotation linear velocity of the endless belt 210 at about 95% or more during the operation time of 600 hours.

TABLE 1

| | | The Beginning | 100 hours | 200 hours | 300 hours | 400 hours | 600 hours |
|---|---|---|---|---|---|---|---|
| Comparative | front | 91.8 | 79.4 | 77.9 | 76 | 92.4 | 85.9 |
| Example 1 | rear | 100 | 86.9 | 75.9 | 78.5 | 88 | 92.7 |
| Comparative | front | 100 | 96.1 | 87.2 | 97.4 | 90.1 | 66.4 |
| Example 2 | rear | 100 | 59.9 | 95.8 | 75.3 | 74.5 | 94.2 |
| Example 1 | front | 97.7 | 97.7 | 95.1 | 99.1 | 96.4 | 95.1 |
| | rear | 99.1 | 96.4 | 97.7 | 96.4 | 93.8 | 95.1 |

FIG. 5 is a schematic cross-sectional view of an example of a configuration rotatably supporting the endless belt 210. Referring to FIG. 5, the rotation member 320 may include a rotation ring 320-1 that is supported to be rotatable with respect to the shaft 312, and a friction pad 320-2, which is arranged in the rotation ring 320-1, to contact with the inner diameter portion 211. The friction pad 320-2 may include a material having a large coefficient of friction, for example, rubber.

According to this configuration, since the friction pad 320-2 contacts with the inner diameter portion 211 of the endless belt 210, the rotation power of the endless belt 210 may be easily transmitted to the rotation ring 320-1. At the same time, the rotation ring 320-1 may include the material having the small frictional resistance. Therefore, a rotation resistance of the rotation member 320 with respect to the shaft 312 may be reduced, and the rotation member 320 may be stably rotated following the rotation of the endless belt 210.

FIG. 6 is a schematic cross-sectional view of an example of a configuration rotatably supporting the endless belt 210. As shown in FIG. 6, the friction pad 320-2 may be arranged on an entire side 320-1*a* of the rotation ring 320-1 facing the inner diameter portion 211 of the endless belt 210.

FIG. 7 is a partial cross-sectional perspective view of an example of a configuration rotatably supporting the endless belt 210. Referring to FIG. 7, a contact surface of the rotation member 320 contacting with the inner diameter portion 211 of the endless belt 210, that is, at least a portion 323 of the outer circumference portion 321 may be made to have a rough surface. Thus, the rotation power of the endless belt 210 may be easily transmitted to the rotation member 320 with an increasing frictional force of the outer circumference portion 321 and the endless belt 210, and the rotation member 320 may be stably rotated by following the rotation of the endless belt 210.

The friction pad 320-2, and the outer circumference portion 321 be made to have a rough surface, described in FIG. 5 to FIG. 7, may also be applied to the configuration in FIG. 4.

A configuration of the heater 220 may be various. For example, the heater 220 may be positioned adjacent to the heating nip 201. FIG. 8 is a schematic cross-sectional view of an example of the fuser 200. Referring to FIG. 8, a recessed portion 242 is provided at a position of the backup member 240 corresponding to the heating nip 201, and the heater 220 may be a ceramic heater positioned in the recessed portion 242. The ceramic heater has a structure in which a metal heating-element pattern layer is positioned on an insulating ceramic substrate, and an insulating layer in positioned thereon. The ceramic substrate mainly includes alumina ($Al_2O_3$), aluminum nitride (AlN), or the like, and the metal heating-element pattern layer includes a Ag—Pd alloy. A glass layer is mainly used as the insulating layer. An electrode for supplying electric current to the metal heating-element pattern layer is positioned on the ceramic substrate. The electrode is connected with, for example, a power supply apparatus, for example, by a connecter, or the like. In this case, the heat of the heater 220 may be uniformly transferred to the endless belt 210, which is in the vicinity of the heating nip 201, by employing the thermal conductive plate 260. In addition, various types of heating may be employed as the heater 220.

Although not illustrated in drawings, an induction heater may be employed as the heater 220. In this case, the endless belt 210 including metal may be employed. A coil for generating a magnetic field may be positioned inside or outside the endless belt 210. When an alternating current is supplied to the coil, eddy current may be generated in the metal endless belt 210 by an electromagnetic induction, and the metal endless belt 210 may be heated by the Joule heat. A metal heating plate may be arranged adjacent to or in contact with the metal endless belt 210. When the alternating current is supplied to the coil, the eddy current may be generated in the metal heating plate by the electromagnetic induction, and the metal heating plate is heated by the Joule heat, and the heat may be transmitted to the metal endless belt 210.

FIG. 9 is a schematic configuration diagram of an example of a fuser 400. Referring to FIG. 9, a fuser 400 may include a rotatable endless belt 410, a pressurizing roller 430 positioned outside the endless belt 410 to form a heating nip 401 together with the endless belt 410, and a heater 420 supplying heat to the heating nip 401. The pressurizing roller 430 applies pressure to the endless belt 410, and rotates, to drive the endless belt 410.

The heater 420 of the present example heats the pressurizing roller 430, and the heat is supplied to the heating nip 401 by the heated pressurizing roller 430. The pressurizing roller 430 may be a metal hollow pipe. A release layer may be provided on the outer circumference of the pressurizing roller 430. The heater 420 may be positioned inside the pressurizing roller 430. The heater 420 may be, for example, a halogen lamp. The heater 420 may be the induction heater. The image surface of the print medium P faces the pressurizing roller 430 side.

An elastic backup member 440 may be positioned inside the endless belt 410 so as to face the pressurizing roller 430. An elastic member 450 provides, to the elastic backup member 440, an elastic force that is towards to the pressurizing roller 430 by having an intermediate member 441 interposed therebetween. By doing so, the elastic backup member 440 is pressurized toward the pressurizing roller 430 by having the endless belt 410 interposed therebetween, and the heating nip 401 in which the print medium passes may be formed between the endless belt 410 and the pressurizing roller 430. When the pressurizing roller 430 that is pressurized while having the endless belt 410 interposed between the elastic backup member 440 and the endless belt 410 is rotated, the endless belt 410 may be driven.

Although not illustrated in drawings, the fuser 400 may include a temperature sensor for sensing the temperature of the pressurizing roller 430. Based on the temperature of the pressurizing roller sensed by the temperature sensor, a controller, which is not shown, may control the heater 420 to maintain the pressurizing roller 430 at a proper heating temperature. The fuser 400 may include an overheating preventing member. When the temperature of the pressurizing roller 430 exceeds a predetermined temperature, the heater 420 cuts off a power transmitted to the heater 420. The overheating preventing member may include, for example, a thermostat. The temperature sensor, and the overheating preventing member, may be installed in contact with or close to the pressurizing roller 430.

Although it is not shown in detail in FIG. 9, the configuration for rotatably supporting the endless belt 210 shown in FIG. 2 to FIG. 7 may be applied as the configuration for rotatably supporting the endless belt 410.

Although the present disclosure has been described with reference to the examples shown in the drawings, it will be understood by those of ordinary skill in the art that various changes in form and details may be made therein without departing from the spirit and scope as defined by the following claims.

The invention claimed is:

1. A fuser including:
an endless belt,
a pressurizing roller to form a heating nip with the endless belt and to rotate to drive the endless belt;
a shaft supporting member, the shaft supporting member including a shaft and a flange;
a rotation member inserted into an inner diameter portion of the endless belt to support the endless belt, the rotation member to be slidably rotatable with respect to the shaft, wherein the rotation member includes:
a rotation ring to be rotatable with respect to the shaft; and
a friction pad arranged on the rotation ring to contact the inner diameter portion of the endless belt; and
a washer interposed between the rotation member and the flange in an axial direction to regulate a movement of the endless belt in the axial direction, the washer is to slide-contact with at least one of the flange and the rotation member.

2. The fuser of claim 1, wherein
the washer is fixed to the shaft supporting member and is to slide-contact with the rotation member.

3. The fuser of claim 1, wherein
the washer is to be rotatable with respect to the shaft and is to slide-contact with the flange.

4. The fuser of claim 1, wherein the washer includes:
an outside washer facing the flange; and
an inside washer interposed between the outside washer and the rotation member.

5. The fuser of claim 4, wherein
the outside washer and the inside washer are installed to be rotatable with respect to the shaft.

6. The fuser of claim 1, wherein
at least a portion of an outer circumference portion of the rotation member contacting the inner diameter portion of the endless belt has a rough surface.

7. A fuser including:
an endless belt,
a pressurizing roller to form a heating nip with the endless belt and to rotate to drive the endless belt;
a heater to supply heat to the heating nip;
a shaft supporting member, the shaft supporting member including a shaft and a flange;
a rotation member inserted into an inner diameter portion of the endless belt to support the endless belt, the rotation member to be slidably rotatable with respect to the shaft; and
a washer interposed between the rotation member and the flange in an axial direction to regulate a movement of the endless belt in the axial direction, the washer is to slide-contact with at least one of the flange and the rotation member, wherein the washer includes:
an outside washer facing the flange and fixed to the shaft supporting member, and
an inside washer interposed between the outside washer and the rotation member and to be rotatable with respect to the shaft.

8. A fuser including:
an endless belt,
a pressurizing roller to form a heating nip with the endless belt, and to rotate to drive the endless belt;
a shaft supporting member, the shaft supporting member including a shaft and a flange;
a rotation member inserted into an inner diameter portion of the endless belt to support the endless belt, the rotation member to be rotatable with respect to the shaft, wherein the rotation member includes:
a rotation ring to be rotatable with respect to the shaft; and
a friction pad arranged on the rotation ring to contact the inner diameter portion of the endless belt; and
a friction reducing member interposed between the flange and the rotation member, the friction reducing member is to slide-contact with at least one of the flange and the rotation member.

9. The fuser of claim 8, wherein
the friction reducing member regulates a movement of the endless belt in an axial direction.

10. The fuser of claim 9, wherein
the friction reducing member is fixed to the shaft supporting member and is to slide-contact with the rotation member.

11. The fuser of claim 9, wherein
the friction reducing member is supported to be rotatable with respect to the shaft and is to slide-contact with the flange.

12. The fuser of claim 9, wherein the friction reducing member includes
an outside member facing the flange, and
an inside member interposed between the outside member and the rotation member, wherein
the outside member is fixed to the shaft supporting member,
the inside member is to be rotatable with respect to the shaft, and
the inside member is to slide-contact the outside member.

13. The fuser of claim 9, wherein the rotation member includes:
a rotation ring to be rotatable with respect to the shaft; and
a friction pad interposed in the rotation ring to contact the inner diameter portion of the endless belt.

14. The fuser of claim 9, wherein at least a portion of an outside circumference portion of the rotation member contacting the inner diameter portion of the endless belt has a rough surface.

* * * * *